US005624253A

United States Patent [19]

Sulzhik et al.

[11] Patent Number: 5,624,253

[45] Date of Patent: *Apr. 29, 1997

[54] RADIATION BURNER

[75] Inventors: Nikolai Sulzhik; Pavel Timoshchenko; Vitaly Trotsenko, all of Kiev, Ukraine

[73] Assignee: Ilya Zborovsky, Dix Hills, N.Y.

[ * ] Notice: The term of this patent shall not extend beyond the expiration date of Pat. No. 5,338,186.

[21] Appl. No.: 273,204

[22] Filed: Jul. 11, 1994

[51] Int. Cl.[6] ..... F24D 7/00

[52] U.S. Cl. ..... 431/116; 431/348; 431/354

[58] Field of Search ..... 431/8, 115, 116, 431/354, 342, 348, 114

[56] References Cited

U.S. PATENT DOCUMENTS

| | | | |
|---|---|---|---|
| 5,044,932 | 9/1991 | Martin et al. | 431/116 |
| 5,135,387 | 8/1992 | Martin et al. | 431/116 |
| 5,154,596 | 10/1992 | Schwartz et al. | 431/116 X |
| 5,338,186 | 8/1994 | Sulzhik et al. | 431/115 |

*Primary Examiner*—Larry Jones
*Attorney, Agent, or Firm*—I. Zbororsky

[57] ABSTRACT

A radiation gas burner comprises a burner stone having an axis and a front surface over which a flame is distributed and which is heated by the flame so as to radiate heat, the burner stone being ring-shaped, an outlet pipe arranged radially inwardly of the burner stone and having an inner cylindrical space with an axially rear inlet and an axially front outlet, means for supplying fuel into the rear inlet of the inner cylindrical space of the outlet pipe, first passage means extending from the front surface of the burner stone and through the burner stone rearwardly, second passage means through which a primary air is supplied into the rear inlet of the inner cylindrical space of the outlet pipe to form a fuel-gas mixture which is supplied through the outlet pipe and exits through the front outlet, and third passage means through which secondary air passes through the burner and exits at the front surface, the first passage means for recirculating combustion products through the burner stone communicating with at least one of the second passage means and the third passage means so as to ballast at least one of the primary air and the secondary air with the combustion products which have passed through the burner stone.

6 Claims, 2 Drawing Sheets

RADIATION BURNER

BACKGROUND OF THE INVENTION

The present invention relates to radiation burners. Such burners are utilized in chemical, oil processing and oil chemical industries, in metallurgy and other areas where it is necessary to provide an indirect radiation heat exchange.

One of such radiation burners is disclosed in Soviet Inventors' Certificate No 954,079. The burner includes an injector with a gas nozzle, a regulating disc, a cylindrical outlet member provided with a reflector and accommodated in a recess of a burner stone fixed in a casing which is arranged with a gap relative to the rear wall of the stone. The above described burner, similarly to other burner devices, has the disadvantage in its low degree of blackness of the refractory burner stone, which at the temperature of 1,520°–1,550° K is approximately 0.3–0.4. This degree of blackness determines a certain density of the heat flow which cannot be increased without the artificial increase of the degree of blackness of the refractory material. Another disadvantage of this burner is that it is not possible to suppress the formation of nitrogen oxides which are quite substantial in the waste products of combustion at temperature of 1,520°–1,550° K. The ejection of the fuel gas from the burner nozzle with a high speed produces high noise which is another disadvantage of the known burner.

Other radiation burners of this type are disclosed for example in U.S. Pat. No. 3,664,424 and French Patent 2,195,328. The radiation burner disclosed in these references includes an injector with a gas nozzle, the burner head and a movable slider. The burner is mounted in a recess formed in a ceramic block which forms a part of the furnace wall. In accordance with another embodiment, the section of the burner which extends outside of the outer surface of the furnace wall is enclosed in a casing provided with a mounting plate which is fixed with a gap to a steel outer plate of the furnace. The casing is provided with a noise-absorbing lining which is held by a perforated sheet. The burner head has a plurality of peripheral longitudinal openings for passing of a prepared gas-air mixture. In order to provide the high quality combustion of the fuel gas of changing content, the burner is provided with air suction of a secondary air. This burner similarly to many otherflow burners has the disadvantage that its construction does not permit substantial increase of its output without the increase of its size. For this reason if the minimal output is to be increased three times, it is necessary to replace the injector and the gas head. The second disadvantage of this burner is that it does not permit a high quality flame-free combustion of the fuel gas, since the burner head is located at a substantially great distance from the surface of the ceramic block, and the gas-air mixture which ejects through the longitudinal openings in the burner head in a substantially thick layer does not completely burn at the surface of the furnace wall. As a rule, the final combustion takes place inside the furnace, which leads to an incomplete combustion and excessive consumption of fuel. Finally, a further disadvantage of the burner is that the suction of the secondary air for increasing the combustion degree of fuel gas is obtained only due to the modification in the furnace combustion chamber. This makes is regulation very difficult. The insufficient quantity of air leads to a chemically incomplete combustion and environmental loading with products of incomplete combustion. If the optimal demand for air is exceeded, this leads to the increase in losses with ejected combustion products and ejection of toxic gases.

A new gas burner was proposed in U.S. patent application Ser. No. 07/985,854. In the radiation burner disclosed in this patent application, combustion products are recirculated through passages provided in the burner stone, in order to reduce the combustion temperature and reduce the contents of nitrogen oxides in the combustion products. It is advisable to further improve the radiation burner of this type.

SUMMARY OF THE INVENTION

Accordingly, it is an object of the present invention to provide a radiation gas burner which is further improvement of the existing burner.

In keeping with these objects and with others which will become apparent hereinafter, one feature of the present invention resides, briefly stated, in a radiation burner which has a burner stone composed of a refractory material and provided with a passage means; means for supplying a fuel through the burner to a front area of the burner stone; means for supplying a primary into the fuel; means for supplying secondary air into the burner; and means for communicating the passage means in the burner stone with at least one of the primary air supplying means and the secondary air supplying means, preferably to both primary and secondary air supplying means.

When the radiation burner is designed in accordance with the present invention, the temperature of flame is substantially reduced and therefore the development of nitrogen oxides is substantially increased.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
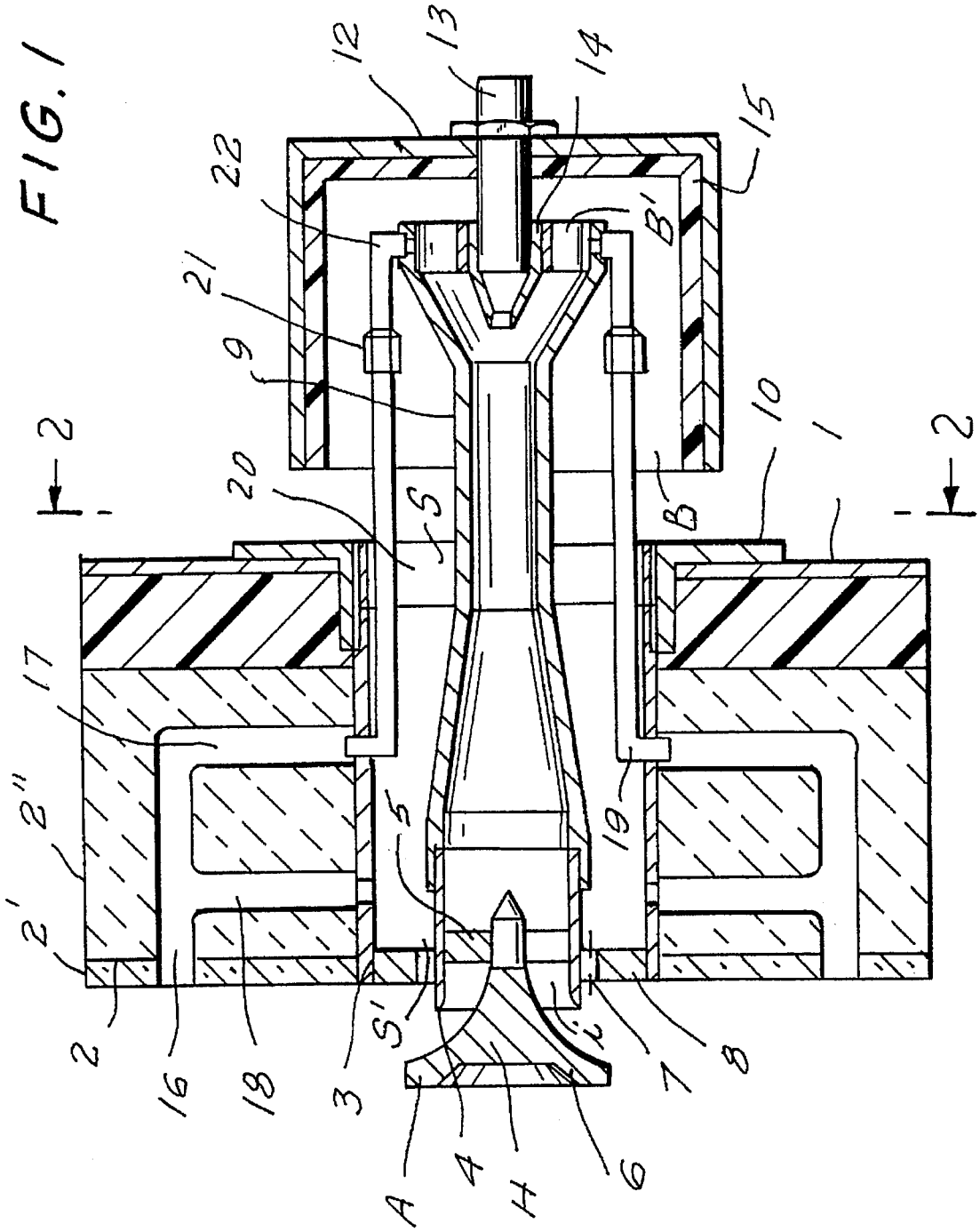
FIG. 1 is a view showing a section of a radiation gas burner in accordance with the present invention.
Figure 2:
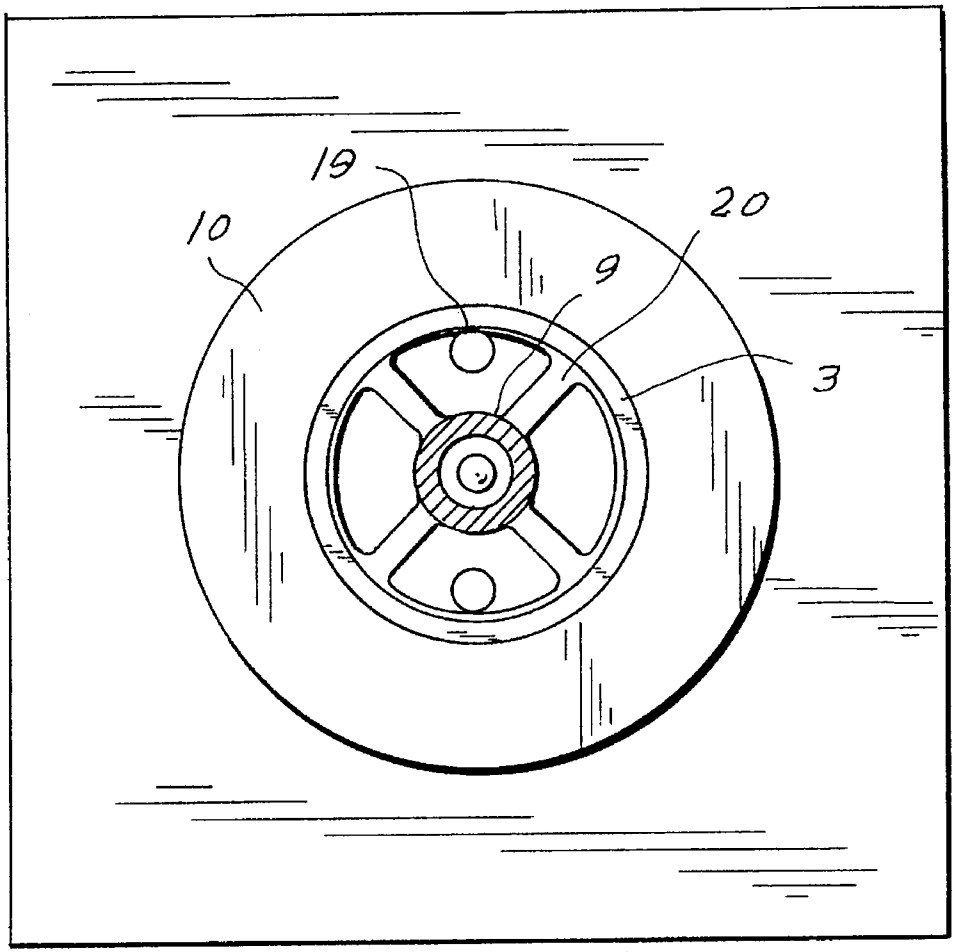
FIG. 2 is a view showing a section taken along the line II—II in FIG. 1.

A radiation gas burner in accordance with the present invention has a mounting plate which is identified with reference numeral 1 and provided with a flange 10 which can be welded to it. A bush 3 is screwed into the flange 10 at one side, and a ring support 2 for an injector 9 is screwed into the flange 10 at another side. The ring support 10 has slots for passage of secondary air and pipes 19. The cylindrical bush 3 has openings for communication of passages 8 provided in a burner stone 2, with an annular gap S for passage of the secondary air. The bush 3 also has openings for insertion of bent ends of the pipes 19 for communication with passages 17 provided in the burner stone 2.

A short pipe 4 is screwed into an outlet part of the injector 9, and a reflector 6 including a cylindrical part A formed as a disc and a part H formed as a body of revolution with a concave generatrix is mounted in the pipe 4 by radial strips 5. The part H of the reflector is located inside the outlet pipe 4 and in cooperation with it forms an annular outlet nozzle i for exiting a gas-air mixture. A ring 8 is mounted upwardly of the pipe 4 in its front part by pins 7 with a gap S, for exiting the secondary air and combustion products.

The radiation burner is further provided with a control device 12 formed as a noise absorbing casing mounted on a pipe 13 so that it can displace axially in order to change the gap between the device 12 and the front surface of the injector 9. Thereby a regulation of the supplied primary air is performed. A nozzle 14 is arranged on the pipe 13 for supplying a fuel gas. The regulating device 12 is provided with noise-absorbing insulation 15 for noise reduction during the operation. Sleeves 22 are mounted in a rear part of the ejector 9 and connected by nuts 21 with the pipes 19 for supplying recirculated combustion products.

During the operation the fuel gas is supplied through the pipe 13 and exits the nozzle 14 as a compressed jet so as to inject the primary air flowing through the gaps B and B'. During this process, sucking (injecting) of combustion products from the front area of the burner is performed through the passages 17 in the burner stone and the pipes 19. This jet which is a mixture products, the primary air and the fuel gas is supplied through the injector 9 and the outlet pipe 4 to the reflector 6, directed by the part H of the reflector and exits along the part A substantially parallel to the front working surface of the burner stone 2. This jet which flows with high speed through the annular nozzle i forms in this area a radification which provides the injection of the secondary air through the passages S and S'. This radification provides the injection of the combustion products supplied through the passages 16 and 18 from the combustion chamber. Through the gap S1 a mixture of the secondary air and combustion products is supplied.

Therefore in the burner the combustion products or the combustion gas is recirculated so as to ballast both the primary air and the secondary air with the products of complete combustion of fuel. In accordance with important feature of the present invention, the passages 16 are arranged at such a distance from the burner axis, where a complete combustion of fuel has been performed. In other words, non-combustible products are supplied into the passages 16. Due to the ballasting of the primary and secondary air the temperature of fuel combustion or in other words the temperature of flame is reduced, and thereby the content of the nitrogen oxides ($NO_x$) is substantially reduced.

As can be seen, in the radiation burner in accordance with the present invention, the ballasting of the primary air is performed only by the combustion products and not by a mixture with the secondary air which usually has still not completely combusted products, and therefore the ballasting in accordance with the present invention substantially reduces the flame temperature. The pipes 19 are arranged so that the secondary air which passes through the gap S flows around the pipes and then the primary air which passes through the gap B flows around the pipes, so that the pipes are cooled and their service life is increased. The ballasting of the primary air and secondary air with the combustion products is very efficient.

As can be seen from FIG. 1, the burner stone 2 has a front part 2' and a rear part 2". The front part is composed of refractory with an increased degree of blackness. For example the front part 2' can be provided with metal oxides which increase the degree of blackness of the burner stone and therefore increase the emissivity, so as to substantially increase the heat exchange.

It will be understood that each of the elements described above, or two or more together, may also find a useful application in other types of constructions differing from the types described above.

While the invention has been illustrated and described as embodied in a radiation gas burner, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A radiation gas burner, comprising a burner stone having an axis and a front surface over which a flame is distributed and which is heated by the flame so as to radiate heat, said burner stone being ring-shaped; an outlet pipe arranged radially inwardly of said burner stone and having an inner cylindrical space with an axially rear inlet and an axially front outlet; means for supplying fuel into said rear inlet of said inner cylindrical space of said outlet pipe; first passage means extending from said front surface of said burner stone and through said burner stone rearwardly; second passage means through which a primary air is supplied into said rear inlet of said inner cylindrical space of said outlet pipe to form a fuel-gas mixture which is supplied through said outlet pipe and exits through said front outlet; and third passage means through which secondary air passes through said burner and exits at said front surface, said first passage means for recirculating combustion products through said burner stone communicating with at least one of said second passage means and said third passage means so as to ballast at least one of the primary air and the secondary air with the combustion products which have passed through said burner stone.

2. A radiation gas burner as defined in claim 1, wherein said outlet pipe is arranged radially inwardly of said burner stone so as to form an annular space between said burner stone and said outlet pipe which annular space constitutes said third passage means.

3. A radiation gas burner as defined in claim 1; and further comprising at least one pipe extending from said first passage means into the interior of said rear inlet of said inner cylindrical space of said outlet pipe so as to form said second passage means.

4. A radiation gas burner as defined in claim 2; and further comprising at least one pipe extending from said first passage means into the interior of said rear inlet of said inner cylindrical space of said outlet pipe so as to form said second passage means.

5. A radiation gas burner as defined in claim 1, wherein said burner stone has a front portion located closer to said front surface and having a higher degree of blackness and a rear portion located axially behind said front portion and having a lower degree of blackness.

6. A radiation gas burner as defined in claim 5, wherein said front portion is composed of a material to which metal oxides are added.

* * * * *